US005311823A

United States Patent [19]

Rudibaugh et al.

[11] Patent Number: 5,311,823

[45] Date of Patent: May 17, 1994

[54] BUMPER SEAL FOR AUTO RACK CAR

[75] Inventors: John W. Rudibaugh, West Chester; Charles L. Vanauken, Dillsburg, both of Pa.

[73] Assignee: Pennsy Corporation, West Chester, Pa.

[21] Appl. No.: 736,290

[22] Filed: Jul. 22, 1991

[51] Int. Cl.[5] ..... B61D 49/00

[52] U.S. Cl. ..... 105/355; 105/404

[58] Field of Search ..... 105/378, 355, 404, 424; 293/128, 154, 155; 267/140; 52/717.1, 718.1, 468; 248/345.1

[56] References Cited

U.S. PATENT DOCUMENTS

| | | | |
|---|---|---|---|
| 2,843,889 | 7/1958 | Keller | 248/345.1 |
| 3,934,385 | 1/1976 | Paulus et al. | 52/717.1 |
| 4,246,303 | 1/1981 | Townsend | 293/128 |
| 4,555,885 | 12/1985 | Raymond et al. | 52/718.1 |
| 4,671,974 | 6/1987 | Murachi | 293/128 |
| 4,913,061 | 4/1990 | Youngblood | 105/378 |
| 4,946,727 | 8/1990 | Kessler | 293/128 |
| 4,964,347 | 10/1990 | Long et al. | 105/404 |
| 4,974,900 | 12/1990 | Destefani et al. | 105/397 |
| 4,988,083 | 1/1991 | Bradley | 267/140 |
| 5,026,588 | 6/1991 | Diekmann | 52/717.1 |
| 5,037,681 | 8/1991 | Yada et al. | 293/128 |

*Primary Examiner*—Douglas C. Butler
*Assistant Examiner*—Kevin D. Rutherford
*Attorney, Agent, or Firm*—John F. A. Earley; John F. A. Earley, III

[57] ABSTRACT

In a railroad auto rack car having an array of side panels with horizontal air gaps between vertically adjacent panels, a strip of continuous flexible resilient plastic material, preferably vinyl having a white color, is fitted onto and adhesively secured to horizontal flanges of vertically adjacent upper and lower side panels to function both as a seal to close the horizontal air gap against swirling road dirt and also as a protective bumper to protect the automobiles from damage from being bumped during loading and unloading of the rack car. The bumper seal in preferred form has upper and lower legs each having a channel which faces the center axis of the bumper for receiving the vertical flanges found along the horizontal edges of the side panels of the rack car. The portion of the bumper seal along the center axis is designed to provide a spring action to accommodate for variations in the width of the air gaps.

12 Claims, 6 Drawing Sheets

BUMPER SEAL FOR AUTO RACK CAR

FIELD OF THE INVENTION

This invention relates to auto rack railroad cars. These are cars intended for volume transportation of motor vehicles such as autos, vans, trucks and the like. See U.S. Pat. Nos. 4,913,061 to Youngblood, issued Apr. 3, 1990, and U.S. Pat. No. 4,964,347 to Long and Hart, issued Oct. 23, 1990, both of which are incorporated herein by reference, for prior art patents relating to railroad auto rack cars.

BACKGROUND OF THE INVENTION

The invention relates particularly to railroad auto rack cars of the type having an array of vertically positioned side panels arranged in horizontal rows and vertical columns, the rows being spaced apart vertically to provide horizontal air gaps between vertically adjacent panels. The upper and lower edge portions of each panel are in the form of a U-shaped channel having vertically disposed flanges which in the case of the lower edge of a panel is an upstanding flange and the case of the upper edge of a panel is a depending flange. The vertically adjacent panels of a column do not abut horizontally; they are spaced apart forming horizontal air gaps through which light and air enter the car. Located between each column of panels is a vertical post which supports the panels and there is a vertical air gap between the posts and the side edge portions of the panels.

While the air gaps between the panels and between the panels and posts have beneficial advantages in that they allow for admittance of light and air, it is has been found that the beneficial effects are more than outweighed by the adverse effects. Specifically, as the train moves along the track at conventional speeds, the air flowing into the interior of the car through the air gaps carries with it dust and dirt which, due to the turbulence and swirling action of the air, tends to damage the paint finishes and vinyl tops of the brand new automobiles which are being transported. This of course is not desirable.

SUMMARY OF THE INVENTION

An object of the present invention is to provide means which may be easily and readily installed at reasonable costs in an auto rack car to prevent dust and dirt from the track areas from being carried into the interior of the rack car during transportation of the automobiles, thereby to avoid damage to the painted surfaces and vinyl tops of the autos.

A further object is to accomplish the foregoing without unduly diminishing the visibility within the car needed by the operators during loading and unloading of the rack cars.

Another object is to provide means in an auto rack car to avoid damage to the doors of the automobiles during opening thereof by the operators during loading and unloading of the rack cars.

Yet another object is to provide a method of protecting the automobiles which are being transported on the auto rack car from damage by bumping into hard rough surfaces along the sides of the rack car and for also reducing the amount of air drawn into the car as the car moves along the tracks, such air ordinarily bringing with it considerable dust, dirt and grime. Yet another object is to provide a continuous strip of flexible resilient synthetic plastic material which functions both as a bumper and also as an air gap seal.

The foregoing objects of invention are achieved, in accordance with the present invention, by the provision and installation of a specially designed strip seal of flexible resilient plastic material adapted to be secured continuously along the flanges which are located at the horizontal edge portions of vertically adjacent side panels of a column to close the horizontal air gap which would otherwise exist between the panels. In a preferred embodiment, the sealed material is white in color so that it is more readily visible to the operators of the automobiles during the loading and unloading operations. In the present application, the seals are referred to as "bumper seals" since they function both as bumpers to protect the sides of the automobiles during loading and unloading and also as seals closing the horizontal air gaps between vertically aligned side panels of a column.

The present invention also provides vertical bumper seals for sealing the vertical gaps between panels and vertical posts, and bumper strips for protecting the edge portions of the panels and the vertical post assemblies.

DETAILED DESCRIPTION OF THE DRAWINGS

Figure 1:
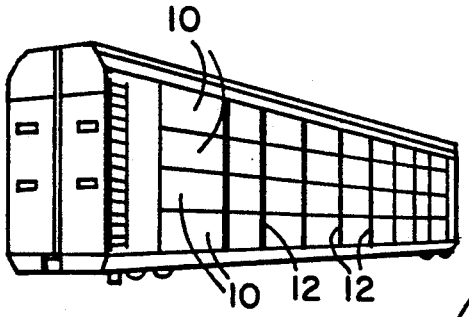
FIG. 1 is a diagrammatic perspective illustration of a typical railroad auto rack car.

In FIG. 1, a typical auto rack car is shown having an array of side panels 10 arranged in horizontal rows and vertical columns, supported on spaced-apart vertical posts 12.

Figure 2:
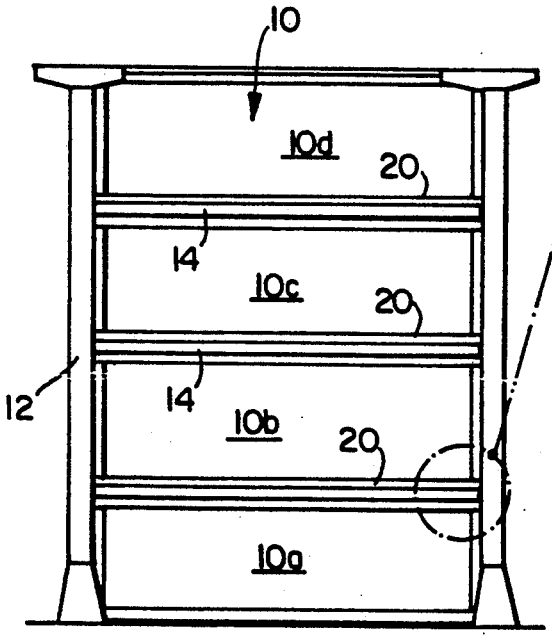
FIG. 2 is a partial view looking in elevation from the interior of the rack car at one column of four vertically aligned side panels supported on vertical posts which are spaced apart horizontally.

In FIG. 2, an interior elevational view is depicted showing one vertical column of four side panels 10*a*, 10*b*, 10*c* and 10*d*, supported between vertical posts 12. FIG. 2 also shows the location of the horizontal air gaps 14 which, except for the bumper seals 20, would exist between vertically adjacent panels 10 of a column.

Figure 3:
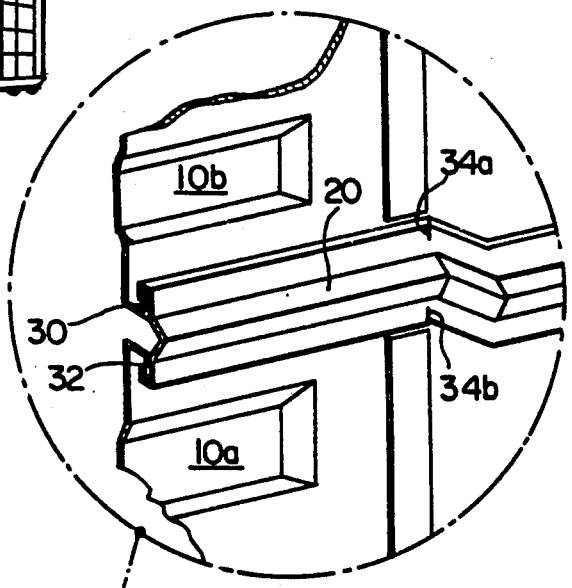
FIG. 3 is an enlarged detailed view of a portion of a vinyl bumper seal at the joint between a pair of vertically adjacent side panels and one of the vertical support posts.

In FIG. 3, the interior of the auto rack car is shown illustrating a portion of the bumper seal 20 at the junction of the vertically adjacent side panels 10*a*, 10*b* with one of the vertical support posts 12.

Figure 4:
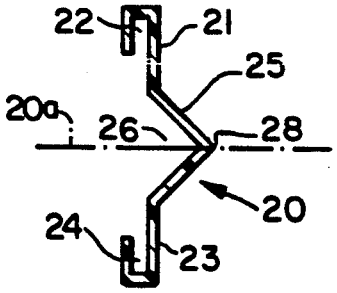
FIG. 4 is a detailed view in cross section of a presently preferred form of bumper seal.

In FIG. 4, a cross-sectional view of the presently preferred form of bumper seal 20 is shown.

As is seen in FIGS. 3 and 4, the bumper seal 20 has a horizontal center axis 20*a*, an upper leg portion 21 having an upper channel 22, and a lower leg portion 23 having a lower channel 24.

Between the upper and lower legs 21, 23 is a V-shaped spring section 25 having a mouth 26 and an apex 28. To install the bumper seal 20, the channel of the upper leg 21 is inserted over an upstanding flange 30 which runs horizontally along the lower edge portion of the upper panel 10*b*. The lower leg 23 of seal 20 is then pulled downwardly and the seal 20 expanded by stretching the V-shaped spring section 25 so that the V becomes flatter, and the lower leg 23 is stretched over the downwardly extending flange 32 which runs horizontally along the upper edge portion of the lower panel 10*a*. The V-shaped spring section 25 of seal 20 is then allowed to contract to form a snug fit between flange 30 and flange 32.

The air gaps 14 between vertically adjacent panels 10*a*–10*d* tend to vary in width. Where the gap is wider, as the lower leg 23 of bumper seal 20 is stretched downwardly to allow the channel 24 of the lower leg 23 to slip over the flange 32 of the lower panel 10*a*, the mouth 26 of the V-section 25 widens and the lateral dimension between the mouth 26 and the apex 28 shortens.

At the junction of a side panel 10 and a support post 12, the leg portions 21, 23 of bumper seal 20 have slits 34*a*, 34*b* to allow the seal 20 to be bent at right angles to fit around and against the post 12 as shown in FIG. 3. The bumper seal 20 may be adhesively secured to the support post 12. Adhesive is also applied to the channels 22, 24 of upper and lower legs 21, 23 of the bumper seal 20 before the seal 20 is placed over the upper and lower flanges 30, 32 of the side panels 10. The bumper seal 20 is preferably provided in continuous lengths (i.e., up to 90 feet in length), to accommodate the length of the rack car.

Figure 5:
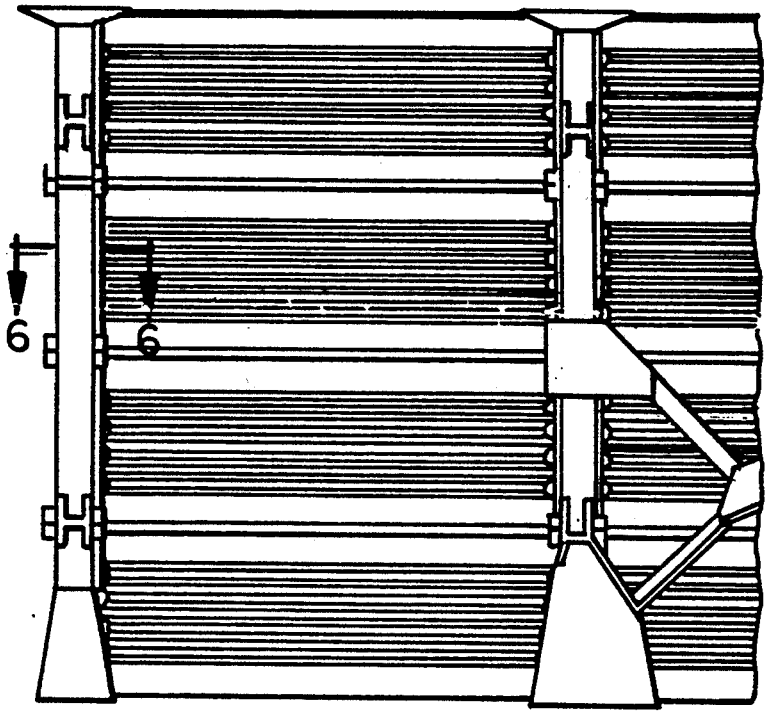
FIG. 5 is a partial view in side elevation showing the inside wall of a typical railroad auto rack car.
Figure 6:
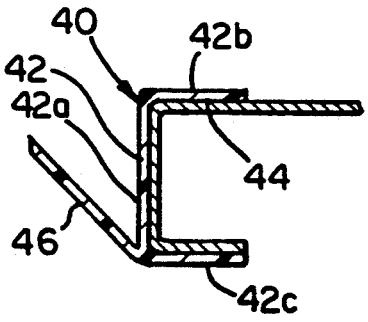
FIG. 6 is a view in cross section taken as indicated by the lines and arrows 6—6 which appear in FIG. 5 and shows one embodiment of a vertical bumper seal constructed in accordance with this invention.
Figure 7:
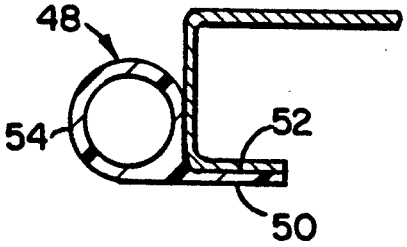
FIG. 7 is a view in cross section which shows another embodiment of a vertical bumper seal constructed in accordance with this invention.

Turning now to FIGS. 5–7, FIG. 5 shows the interior wall of an auto rack railroad car, a partial view, and FIG. 6 shows a horizontal cross section taken as indicated by the lines and arrows 6—6 in FIG. 5, and shows a vertical bumper seal 40 which comprises a strip 42 with a central portion 42*a* with end portions 42*b* and 42*c* extending therefrom. Strip 42 is adhered to the end portion of a panel by a layer 44 of adhesive, preferably butyl adhesive. A spacer flap 46 extends from strip 42 at the corner between central portion 42*a* and end portion 42*c* to close the vertical gap between the panel and the post. Spacer flap 46 is wider than the gap so as to accommodate gaps of various widths.

Referring to FIG. 7, there is shown another vertical bumper 48 which comprises a strip 50 which is attached to the flange of a panel by a layer of adhesive 52. Strip 50 is attached to a spacer 54 which is in the form of a hollow cylinder. The diameter of the spacer cylinder is wider than the space between the side panel and the adjacent vertical posts, and the cylinder is compressible so as to fit vertical gaps of various widths.

Vertical bumper 40 and vertical bumper 48 are made of vinyl.

Figure 8:
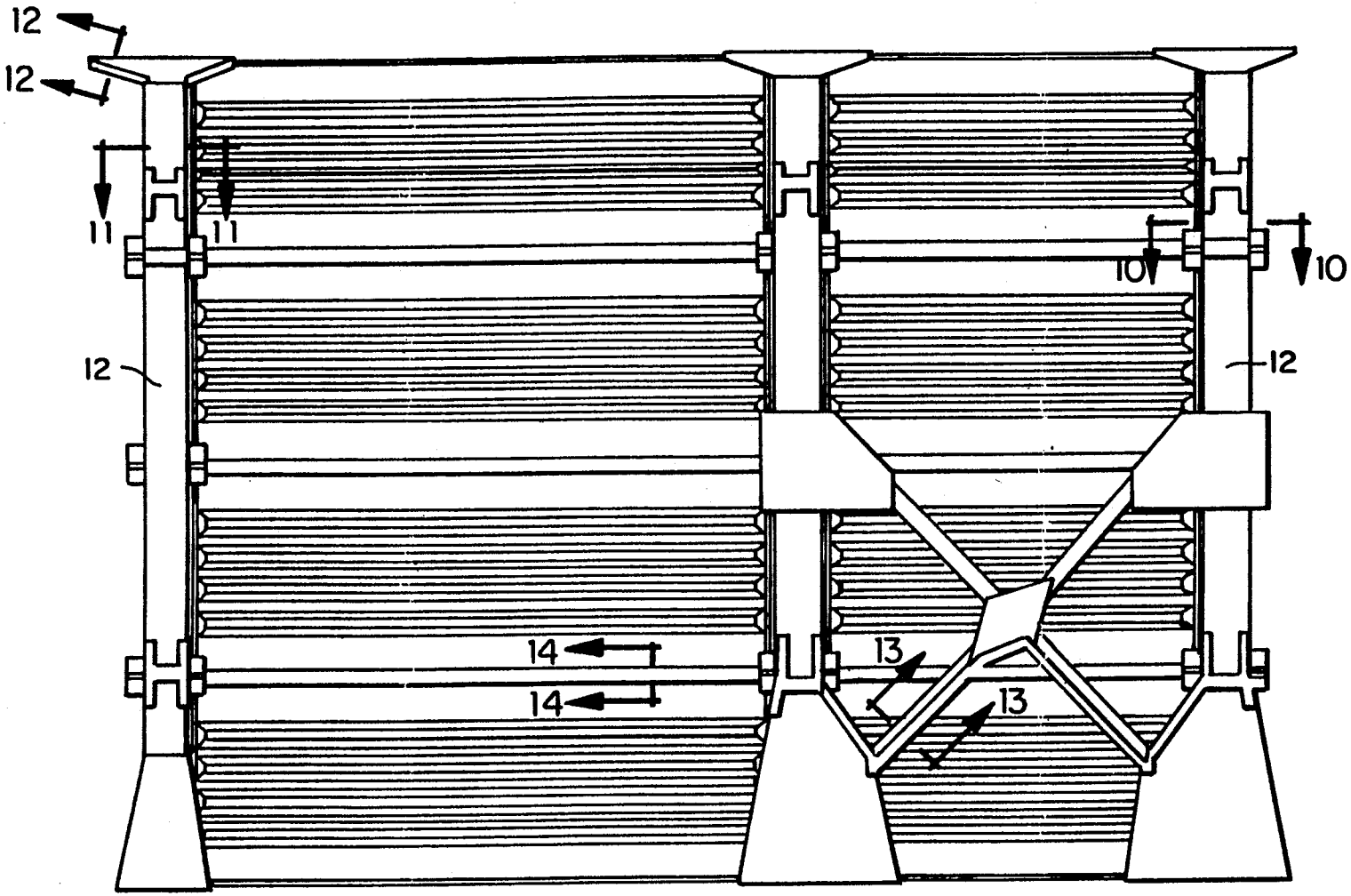
FIG. 8 is a partial view in elevation of the panel wall of an auto rack railroad car looking from the inside of the car.
Figure 9:
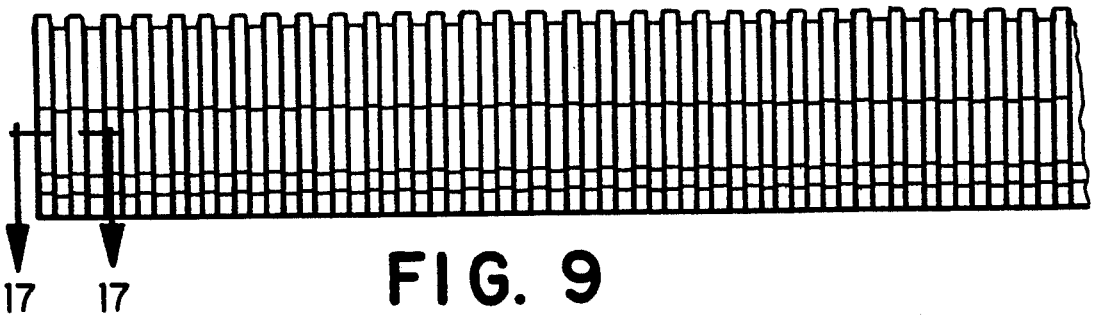
FIG. 9 is a partial view in elevation of a roof of an auto rack railroad car.

Referring now to FIGS. 8 through 16, FIG. 8 shows a partial view of the inside wall of a auto rack railroad car, and FIG. 9 shows a partial view in elevation of the roof of the railroad car.

Figure 10:
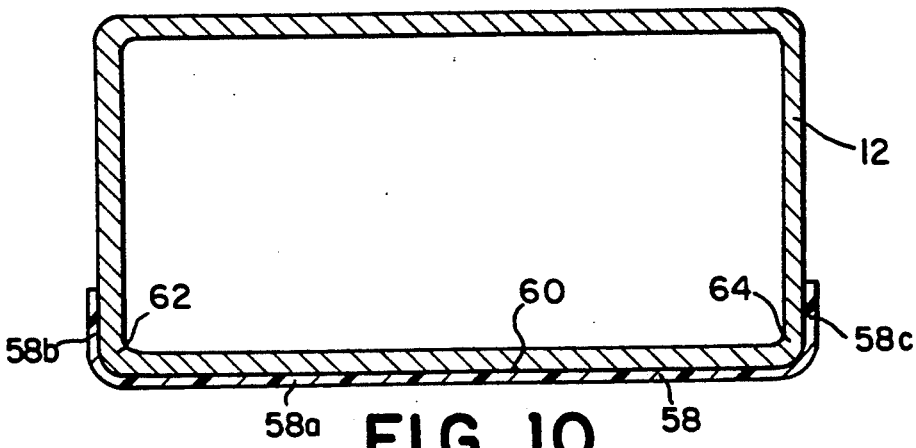
FIG. 10 is a view in horizontal cross section of a vertical post taken as indicated by the lines and arrows 10—10 which appear in FIG. 8.

FIG. 10 shows a view in cross section of a vertical post 12 taken as indicated by the lines and arrows 10—10 which appear in FIG. 8 and shows a strip 58 of vinyl for protecting the inner face and corners of the post. Strip 58 is adhered to the outside surface of the post by a layer of adhesive 60. Strip 58 has a central portion 58*a*, an end portion 58*b* which turns a post corner 62, and an end portion 58*c* which turns a post corner 64.

Figure 11:
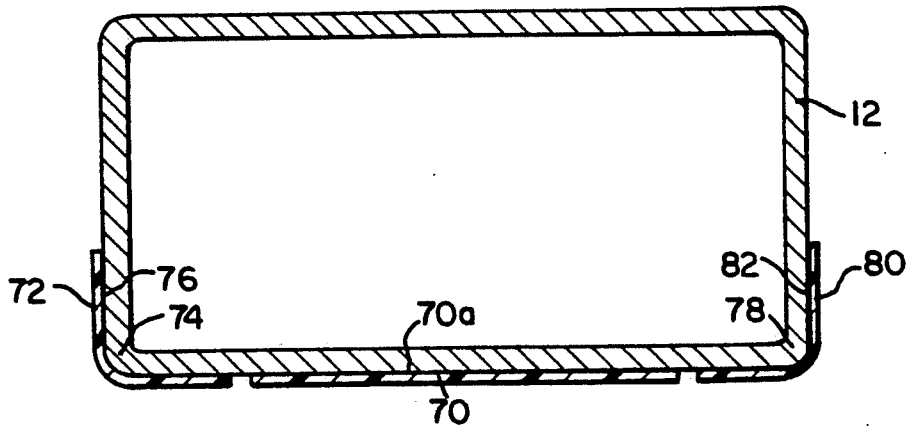
FIG. 11 is another horizontal cross section of a vertical post taken as indicated by the lines and arrows 11—11 which appear in FIG. 8.

FIG. 11 is a view in section of a vertical post 12 taken as indicated by the lines and arrows 11—11 which appear in FIG. 8 and shows a strip 70 which is adhesively affixed by an adhesive layer 70*a* to the central portion of a wall of post 12. A corner strip 72 of vinyl is adhered to corner 74 of post 12 by an adhesive layer 76, and the strip 72 is adhered to both the front wall of post 12 and the side wall of the post.

On the other front corner 78 of the post 12, a strip 80 is adhered to the post 12 by an adhesive layer 82, and the strip 80 bends around the corner of post 12 and is adhered to the side wall of the corner and to the front wall of the corner.

Figure 12:
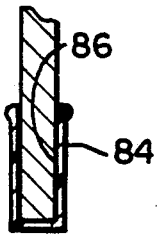
FIG. 12 is a view in section taken as indicated by the lines and arrows 12—12 which appear in FIG. 8.

FIG. 12 shows a view in section of the top of a post 12 taken as indicated by the lines and arrows 12—12 which appear in FIG. 8. Here, a strip 84 of vinyl is adhered to this portion of the post 12 by a layer 86 of adhesive which forms a U-shape as it bends around two corners.

Figure 13:
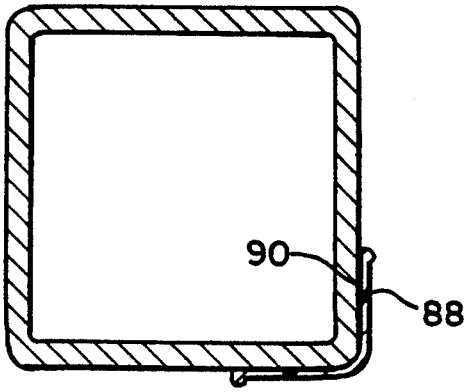
FIG. 13 is a view in cross section taken as indicated by the lines and arrows 13—13 which appear in FIG. 8.

FIG. 13 is a view in section as taken by the lines and arrows 13—13 which appear in FIG. 8 and shows a strip 88 of vinyl which is adhered to a corner by a layer of adhesive 90.

Figure 14:
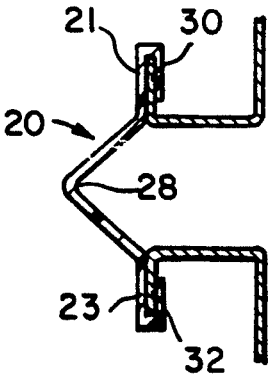
FIG. 14 is a view in cross section taken as indicated by the lines and arrows 14—14 which appear in FIG. 8.

FIG. 14 is a view in section taken as indicated by the lines and arrows 14—14 which appear in FIG. 8 and shows bumper seal 20 with its upper leg 21 affixed to upstanding flange 30 and lower leg 23 affixed to downwardly extending flange 32.

Figure 16:
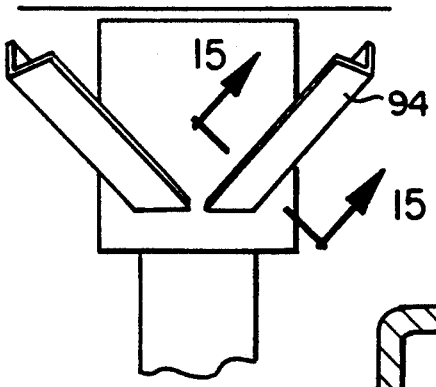
FIG. 16 is a partial view of one of the deck braces of the auto rack railroad car.
Figure 15:
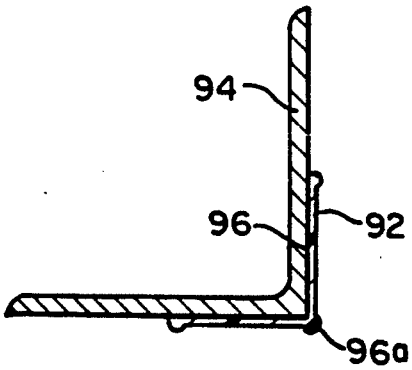
FIG. 15 is a view in cross section taken as indicated by the lines and arrows 15—15 which appear in FIG. 16.

FIG. 15 is a view in section taken as indicated by the lines and arrows 15–15 which appear in FIG. 16 and shows a strip of vinyl 92 adhered to an angle 94 by a layer of adhesive 96. Strip 92 is provided with a corner crimp 96*a* which makes it easier to bend the strip 92 around the corner. Vinyl strips are normally difficult to apply around corners because vinyl has a memory and wants to return to its original flat condition. However, strip 92, with its corner crimp 96*a* is more readily adapted to be affixed to a corner, like the corner of a post.

FIG. 16 is a partial view of a deck brace, and shows the angle iron 94.

Figure 17:
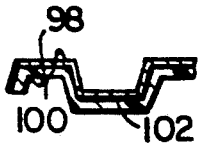
FIG. 17 is a view in section taken as indicated by the lines and arrows 17—17 which appear in FIG. 9.

FIG. 17 is a partial view in section taken as indicated by the lines and arrows 17—17 which appear in FIG. 9 and shows a portion of the corrugated roof with a strip 98 adhered to the roof corrugations 100 by a layer 102 of adhesive.

Figure 18:
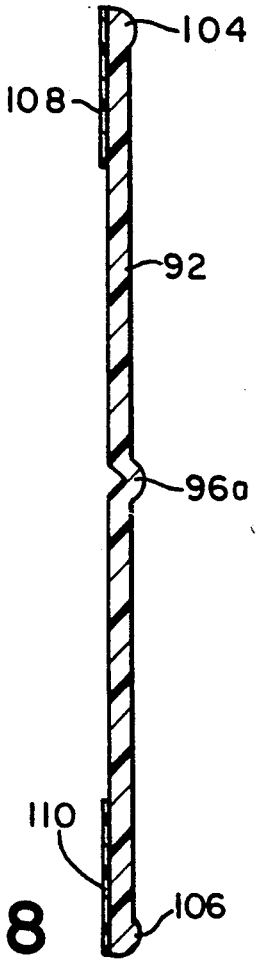
FIG. 18 is a view in section of a bumper strip having a single crimp constructed in accordance with this invention.

FIG. 18 shows an enlarged view in section of strip 92 with its crimp 96*a*, and shows an upper bump or protective pad 104, a lower bump or protective pad 106, an upper layer 108 of adhesive and a lower layer 110 of adhesive. The material of strip 92 is vinyl, 60A durometer, white in color, and it may be provided in 90 foot rolls.

Figure 19:
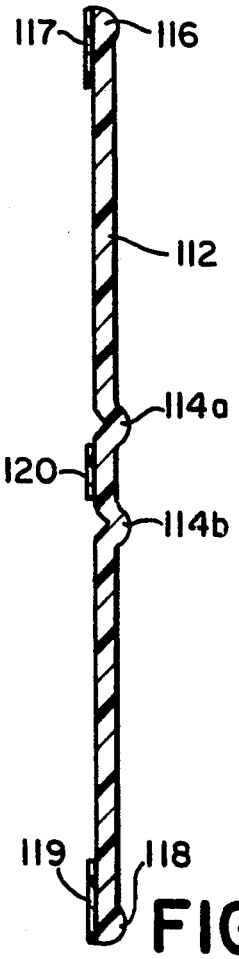
FIG. 19 is a view in cross section of a bumper strip having two crimps.

FIG. 19 shows a view in cross section of a strip 112 of vinyl having a double crimp 114*a* and 114*b* which enables it to be more easily affixed to corners. The strip also has an upper bump 116, an upper adhesive layer 117, a lower bump or protective pad 118, a lower adhesive layer 119, and a central adhesive layer 120 which is located between bumps or protective pads 114*a* and 114*b* on the inner surface of the strip 112.

Figure 20:
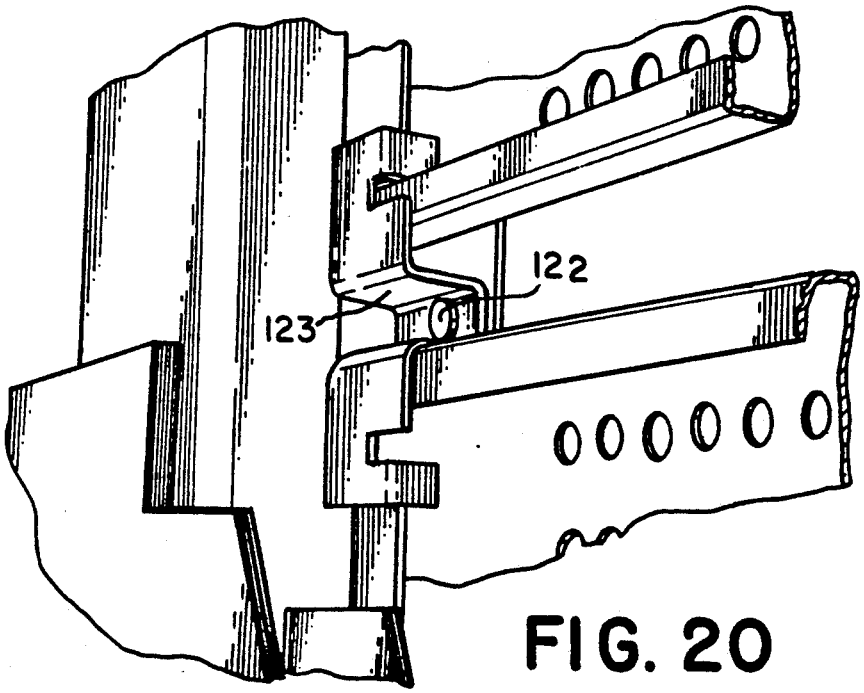
FIG. 20 is a partial view of a vertical post and its bracket which is clamped to two side panels.

FIG. 20 shows a partial view of a vertical post and its bracket which is clamped onto two panels by a bolt 122 and a clamping plate 123.

Referring to FIG. 17, strip 98 is easily attached to the corrugated roof section because it has a thickness of 1/16 of an inch, which makes it very pliable and easily installed in the corrugations of the roof section. Bumper strip 98 is adhered to the roof panels by an adhesive coating that is made integral with the vinyl strip 98.

Flat and angle sections that require a protective strip are covered with bumper strips as shown in FIGS. 11, 12, 13 and 15.

In areas where the bumper strip must be applied around post corners or angled surfaces, a crimp is provided in the center of the bumper strip as is shown in FIG. 15 by strip 92 and also in FIGS. 18 and 19. Without the crimps, the vinyl strip has a memory and tries to spring back to its original flat condition. The crimp helps overcome this inherent condition of vinyl extrusions.

By effectively sealing the auto rack side panels, both the horizontal and the vertical air gaps, turbulent air and dirt are prevented from entering the auto rack car. Therefore, automobile paint surfaces are not subjected to swirling dirt and grit inside the railroad car during transit.

The vertical bumper strips are preferably made from a similar vinyl material as the bumper seals 20, but with a harder durometer (90A) to resist air flow. The vertical bumper seals are not at a location where automobile doors being opened are likely to come in contact with the vertical seals.

We claim:

1. An expandable bumper seal for sealing the horizontal gap between side panels of auto rack railroad cars to protect the autos from damage by bumping and from swirling dirt, comprising a strip of flexible resilient synthetic plastic material having a horizontal center axis, an upper leg above and a lower leg below the center axis, and spring means at the center axis for allowing extension and retraction of the bumper seal in the vertical sense.

said upper and lower legs having channel means including an upper and lower channel facing toward the center axis for receiving and grasping a flange member of a side panel of an auto rack railroad car, said spring means also exerting a force to move said channels toward each other.

2. A bumper seal according to claim 1, wherein said plastic material is vinyl having a white color to enhance visibility.

3. In a railroad auto rack car for transporting motor vehicles including autos, vans and trucks, said rack cars having an array of side panels arranged in horizontal rows and vertical columns with vertically adjacent side panels of a column being separated by a horizontal air gap, the horizontal edges of a side panel being equipped with flanges which extend downwardly from the upper edges of the side panel and extend upwardly from the lower edge of the side panel, the improvement comprising resilient bumper seal means for protecting against damage to the motor vehicles caused by bumping during loading and unloading of motor vehicles in the rack car and for sealing the horizontal air gap to prevent the entrance of track dirt and dust into the interior of the rack car, said bumper seal means having an upper and lower leg above and below a horizontal center axis of the bumper seal, attachment means at the upper and lower legs for attaching to the flanges of vertically adjacent side panels, an spring means along the center axis of the bumper seal means for exerting a pulling force on the upper and lower legs to pull them toward each other and for allowing extension and retraction of the bumper seal in the vertical dimension to accommodate variations in the width of the air gap, wherein the attachment means comprises channel-shaped portions, and wherein said channel-shaped portions face the horizontal plane of the center axis of the bumper seal.

4. Apparatus according to claim 3, wherein the bumper seal means is a strip formed of vinyl having a white color to improve the visibility of the bumper means within the rack car.

5. In an enclosed railroad auto rack car for carrying autos, vans and trucks, said rack car having a plurality of side panels arranged in horizontal rows and vertical columns and vertical posts between the columns for supporting the panels, said panels being spaced-apart vertically forming horizontal air gaps between the panels, said side panels having vertically oriented flanges running horizontally along the upper and lower edges of the panels, the improvement comprising a bumper seal for closing the horizontal air gaps, said bumper seal being formed of soft resilient plastic material for protecting the vehicle doors from damage from bumping when opened inside the rack car, said bumper seal being characterized by upper and lower leg portions having channel-shaped end portions for receiving the spaced-apart flanges of vertically adjacent panels, thereby to close the air gap therebetween, said bumper seal being further characterized by a V-shaped spring means located between the upper and lower leg portions, said V-shaped spring means being adapted to be spread apart to accommodate a wider air gap and to then retract to form a tight fit.

6. Apparatus according to claim 5, further characterized in that said bumper seal is formed of vinyl having a white color.

7. Apparatus according to claim 5, wherein the bumper seal has a slit at the leg portions to allow the seal to fit around a vertical support post.

8. Apparatus according to claim 5, wherein adhesive is applied to the bumper leg portions for securing the legs to the flanges.

9. A method of improving a railraod auto rack car for volume transportation of motor vehicles including automobiles, vans, and trucks, providing a bumper seal strip made of flexible resilient plastic material having a horizontal center axis, an upper leg above and a lower leg below the center axis, and spring means at the center axis for allowing extension and retraction of the bumper seal in the vertical sense, said upper and lower legs each characterized by a channel facing toward the center axis for receiving a flange member of a side panel of an auto rack railroad car, applying an adhesive to the channels in the upper and lower legs, hooking the upper channel around the vertically upstanding flange of an upper side panel, pulling the lower leg portion of the bumper seal downwardly and extending the spring mans so as to extend the lower channel below the downwardly extending flange of a lower side panel, hooking the lower channel over the downwardly extending flange of the lower side panel, retracting the spring means to form a tight fit between the lower channel and the downwardly extending flange of the side panel, and allowing the adhesive to set between said channels and said flanges.

10. In an enclosed railroad auto rack car for carrying autos, vans and trucks, said rack car having a plurality of side panels arranged in horizontal rows and vertical columns and vertical posts between the columns for supporting the panels, said panels being spaced-apart vertically forming horizontal air gaps between the panels, said side panels having vertically oriented flanges running horizontally along the upper and lower edges of the panels, said side panels having a vertical edge portion and vertical gaps between the vertical posts and the vertical edge portions of the side panels, the improvement comprising a bumper seal for closing the horizontal air gaps, a strip of flexible synthetic plastic material, a coating of adhesive on one surface of the strip adapted to attache the strip tot he side panel, and spacer means extending from the strip and adapted to fit between the vertical edge portion of a side panel and the vertical post adjacent to the side panel for sealing the vertical gaps, said spacer means being a flap hinged to the strip, said flap being wider than the space between the side pane land the adjacent vertical post.

11. In an enclosed railroad auto rack car for carrying autos, vans and trucks, said rack car having a plurality of side panels arranged in horizontal rows and vertical columns and vertical posts between the columns for supporting the panels, said panels being spaced-apart vertically forming horizontal air gaps between the panels, said side panels having vertically oriented flanges running horizontally along the upper and lower edges of the panels, said side panels having a vertical edge portion and vertical gaps between the vertical posts and the vertical edge portions of the side panels, the improvement comprising a bumper seal for closing the horizontal air gaps, a strip of flexible synthetic plastic material, a coating of adhesive on one surface of the strip adapted to attache the strip tot he side panel, and spacer means extending from the strip and adapted to fit between the vertical edge portion of a side panel and the vertical post adjacent to the side panel for sealing the vertical gaps, said spacer means being a hollow cylinder, said cylinder being wider in diameter than the space between the side panel an the adjacent vertical post.

12. In an enclosed railroad auto rack car for carrying autos, vans and trucks, said rack car having a plurality of side panels arranged in horizontal rows and vertical columns and vertical posts between the columns for supporting the panels, said panels being spaced-apart vertically forming horizontal air gaps between the panels, said side panels having vertically oriented flanges running horizontally along the upper and lower edges of the panels, the improvement comprising a bumper seal for closing the horizontal air gaps, flexible synthetic plastic strip means for protecting the side panels and the vertical posts, and a coating of adhesive on one surface of the strip means for attaching the strip means between the edge portions of a side panel and the support brackets of the vertical posts, said strip means being made of a material which has a memory which urges the strip means to return to its original flat condition, said strip means having a crimp which makes it easier to fold the strip means around corners and overcome the memory of the material.

* * * * *